United States Patent [19]

Garabedian et al.

[11] Patent Number: 4,564,127

[45] Date of Patent: Jan. 14, 1986

[54] DISPENSER WITH PUMP FOR DISPENSING LIQUID FROM A COLLAPSIBLE BAG

[75] Inventors: Michael E. Garabedian, Arlington; Glenn E. Morgan, Sr., Ft. Worth, both of Tex.

[73] Assignee: Dexide, Inc., Fort Worth, Tex.

[21] Appl. No.: 592,075

[22] Filed: Mar. 22, 1984

[51] Int. Cl.[4] ..... B65D 35/56

[52] U.S. Cl. ..... 222/96; 222/105; 222/179

[58] Field of Search ..... 222/96, 105, 179, 181, 222/106, 214, 491, 494, 212

[56] References Cited

U.S. PATENT DOCUMENTS

| | | | |
|---|---|---|---|
| 2,535,671 | 12/1950 | Cutler | 222/105 |
| 2,597,410 | 5/1952 | Tronson | 222/490 |
| 2,611,515 | 9/1952 | Smith | 222/213 |
| 2,668,637 | 2/1954 | Gilmore | 222/95 |
| 2,788,921 | 4/1957 | Galinas | 222/212 |
| 3,368,722 | 2/1968 | Wallace | 222/214 |
| 3,773,233 | 11/1973 | Souza | 222/92 |
| 3,815,794 | 6/1974 | Carlisle | 222/491 |
| 3,926,347 | 12/1975 | Low et al. | 222/185 |
| 3,981,419 | 9/1976 | Nilson . | |
| 4,065,033 | 12/1977 | Nilson | 222/107 |
| 4,139,124 | 2/1979 | Ferrante | 222/110 |
| 4,141,474 | 2/1979 | Nilson | 222/493 |
| 4,149,633 | 4/1979 | Nilson | 206/219 |
| 4,163,509 | 8/1979 | Amneus | 222/105 X |
| 4,166,553 | 9/1979 | Fraterrigo | 222/181 |
| 4,256,242 | 3/1981 | Christine | 222/207 |
| 4,258,865 | 3/1981 | Vahl et al. | 222/213 |
| 4,324,348 | 4/1982 | Johnson et al. | 222/181 |
| 4,349,133 | 9/1982 | Christine | 222/183 |
| 4,463,876 | 8/1984 | Swallert | 222/96 X |

OTHER PUBLICATIONS

Invention Disclosure submitted by Glen Eugene Morgan, Sr. under the Disclosure Document Program received by the Patent Office on 11-22-82.

*Primary Examiner*—Stanley H. Tollberg

*Attorney, Agent, or Firm*—Richards, Harris, Medlock & Andrews

[57] ABSTRACT

A liquid dispenser and collapsible bag, the bag preferably having a self-sealing valve inherently formed from the sides of the bag, the bag being equipped with clips to engage clip receiving structure on the dispenser. The dispenser having a frame, with a bag support structure, a pump structure, and a clip receiving structure to engage the bag clips for the opening and closing of the valve.

11 Claims, 10 Drawing Figures

DISPENSER WITH PUMP FOR DISPENSING LIQUID FROM A COLLAPSIBLE BAG

TECHNICAL FIELD

The present invention relates to liquid dispensers. More particularly, the present invention relates to a liquid dispenser with a pump mechanism for extracting material from the bag and means for interacting with a valve on a collapsible bag. The dispenser and bag combination may be useful in the dispensing of liquids of varying viscosity such as pastes, glues, shampoos, soaps, etc.

BACKGROUND OF THE INVENTION

Numerous types of liquid dispensers have been known in the art. Many have been wall-mountable wherein the dispenser serves as a support for a liquid reservoir. Flow of liquid from the reservoir may be by gravity or a combination of gravity and mechanical force. Liquid is used herein broadly to include flowable material such as colloidal mixtures, and pastes.

Dispensers utilizing gravity in combination with mechanical force have had two major problems. The first being obtaining an effective seal across the opening of the liquid reservoir to prevent leakage, and the second being rather complex mechanical and specially configured reservoirs such as illustrated in U.S. Pat. Nos. 4,256,242; 4,258,865; and 4,349,133. These dispensers are not readily adapted to the dispensing of various liquids through wide viscosity ranges.

Thus, the art has a need for a liquid dispenser which can be readily adapted to dispensing liquids of various viscosities and a dispenser which provides for the positive seal of the liquid reservoir to prevent leakage. The present invention can be adapted to dispense liquids having a wide range of viscosities.

SUMMARY OF THE INVENTION

Figure 1:
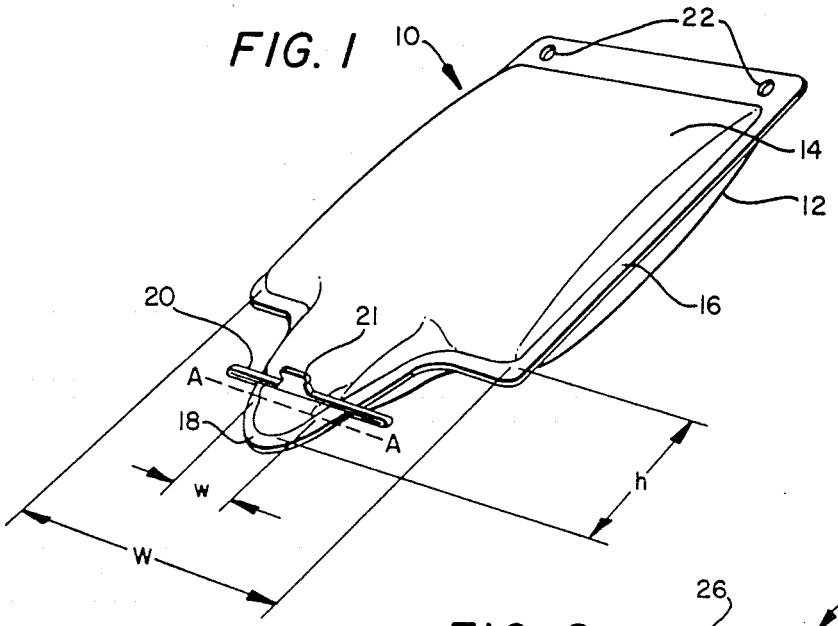
FIG. 1 is an isometric view of the collapsible bag.

In one aspect the present invention relates to a collapsible bag comprised of two flexible sheets laminated together with the lower depending portion of decreasing width to form a valve. In the preferred embodiment the valve formed by the bag is self-sealing. The lowermost valve section has a clip mechanism attached to the outside of the bag. The clip mechanism is provided as a means of interacting with the clip receiving mechanism on the dispenser of the present invention. The collapsible bag may be in a wide variety of shapes as long as the lower depending portion is constructed so as to preferably provide a self-sealing valve integrally formed by the sides of the bag. The bag containing the liquid is completely sealed about its periphery for shipment which prevents leakage. When the bag is placed in the dispenser the seal across the lower depending portion is cut away below the clip mechanism to form the self-sealing valve. Under normal atmospheric pressure the liquid will not flow through the self-sealing valve. When additional pressure is applied, liquid will flow from the bag. The flow will stop when pressure is removed, because the bag is constructed such that it is resilient and the valve will resume the closed position when pressure is removed. In the preferred embodiment the bag is made from two flexible sheets laminated together which have an upper rectangular portion of H height and W width, and a lower depending portion of about $\frac{1}{2}$ W or more in height and the bottom width of about 1/5 W or less.

In another aspect the present invention relates to a dispenser apparatus. The dispenser is composed of a frame for holding the collapsible bag, a pump mechanism pivotal with respect to the frame, a first and second clip receiving means attached to the frame at least one of which is moveable with respect to the frame. The clip receivers interact with the clip mechanism on the collapsible bag and an actuating mechanism which actuates the pump arm and the bag valve. The valve actuation mechanism functions as a check valve, because in the normal position the clips on the bag are pushed together, thereby forcing the sides of the self-sealing bag together to form a positive seal.

In another aspect the present invention relates to the combination of the container and the dispenser such that the container is held in a generally vertical position with the valve portion of the collapsible bag being at the lower section of the dispenser. The actuating mechanism of the dispenser is connected with the clips of the bag valve and the portion of the bag immediately above the valve is adjacent to the pump arm. The clips attached to the bag at the valve area cooperate with the clip receivers and the valve actuating mechanism of the dispenser to open the valve to allow dispensing of fluid and maintain the valve in the closed position when delivery of the liquid is not desired.

DETAILED DESCRIPTION

The present invention provides for a collapsible bag which is constructed so as to provide an upper fluid reservoir, a lower charging reservoir and preferably a self-sealing valve integrally from the walls of the container to which is attached a clip mechanism. The bag is constructed from flexible material such that a self-sealing valve is formed. The constructed bag is resilient so that upon the application of pressure greater than atmospheric, the valve will open to permit dispensing of fluid. When the pressure is removed, the bag is resilient and the valve returns to the closed position. In another aspect the invention relates to a dispenser for holding the bag having a frame, bag support, a pump, a valve actuating/pump mechanism which functions to open the bag's valve simultaneously with the pumping action to permit delivery of the fluid. The return of the actuating/pumping mechanism to its normal position not only permits the self-sealing valve of the bag to close, but also functions to apply pressure to the self-sealing valve to provide a secure seal.

Figure 2:
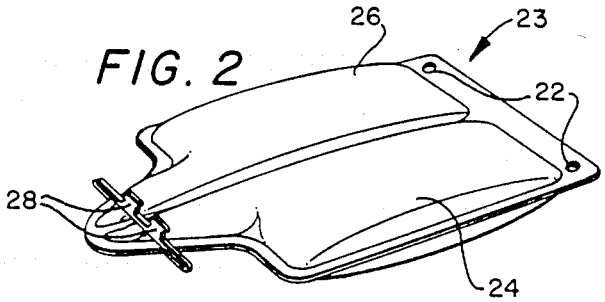
FIG. 2 is an isometric view of a second configuration of the bag.

FIG. 1 is an isometric view of the collapsible bag of the present invention. The collapsible bag 10 is formed by the lamination of a back sheet 12 to a front sheet 14 sealed around their periphery 16. The laminated sheets form a bag for containing the liquid to be dispensed. The sheets may be a lamination of materials or a single sheet of material. The sheets must be impermeable to the liquid to be contained in the bag. The lower depending portion of the bag 10 is narrower than the upper portion. Above the sealed portion of the bottom 18 is clip bar 20 which has a front clip 21 and a rear clip (not shown). The top of the bag can be provided with two holes 22 for attaching it to the frame of the dispenser. The lower depending portion of the bag should be dimensioned in such a manner that it is capable of forming a seal which seals the bag under normal atmospheric pressure when the bottom seal 18 of the bag is cut off, for example along line AA of FIG. 1. In general, this requires an elongated and narrower lower depending portion so dimensioned as to form a self-sealing valve when force is not applied on the bag; and the upper reservoir portion can be of many shapes. In the preferred embodiment the bag has an upper reservoir section of generally rectangular shape with a width W, and a lower depending portion of width, w, being $\frac{1}{4}$ W or less, and a height, h, of $\frac{1}{3}$ W or more. The bag can be a wide variety of shapes and can be a multichambered bag 23 as shown in FIG. 2. In the case of a multichamber bag the lower depending portion of each chamber is preferably shaped so as to be self-sealing. As shown in FIG. 2 the chambers 24 and 26 can be of different sizes. A clip mechanism 28 is provided for the valve of each chamber. Such a bag would be suitable for epoxy glues having a catalyst and a resin.

The bag containing liquid when prepared for shipment is sealed around its periphery and is very resistent to rupture by impact and rough handling. The bag material must be flexible. A wide variety of materials are suitable. The material is generally selected based on compatibility with the product, strength for storage and transportation, and relative flexibility. The bag material may also be a laminant of different materials. Polymeric films are especially suitable for use in forming the bag of the present invention. Suitable polymeric films include a lamination of ethyl vinyl acetate (EVA), nylon, ethyl vinyl acetate, and low density polyethylene (LDPE); a laminant of medium to high density polyethylene and EVA; a laminant of nylon, medium density polyethylene (MDPE) and low density polyethylene; a laminant of nylon and medium density polyethylene; and a laminant of polyester and low density polyethylene. A material found suitable for antimicrobial soaps containing agents such as parachlorometaxylenol, or iodophor is a lamination of EVA/nylon/EVA/polyethylene/LDPE, such as sold by American Can under the trade designation #XZ2193.011. When packaging a very caustic or acidic compound, a suitable material would be a lamination of polyester/HPDE/EVA or polyester/HPDE/LDPE, because such a material would not be attacked by the liquid. Suitable packaging for a typical liquid detergent would be a nylon/MDPE/LDPE laminant or a nylon/MDPE laminant.

The bag is preferably constructed from a material which has sufficient strength to be durable in storage and transportation. Bag failure usually occurs from stress applied to the sheet or stress along the line between the sealed and unsealed portion of the bag. Forces exerted on the bag can easily exceed 100 pounds per square inch on a surface and over 300 pounds per square inch along the seal. Nevertheless, bags can be constructed with sufficient strength to withstand very severe handling. For example, a bag was constructed from 5 mil thick laminate of EVA/nylon/EVA/-Poly/LDPE sold by American Can under the trade designation XZ2193.011 and filled with 24 ounces of a liquid soap composition weighing 1.5 lbs. Bags were then dropped from 8–12 feet 10–15 times before failure occurred. These bags can be made in a conventional manner, such as sealing two sheets together utilizing a platen stamp of the desired shape, affixing the clip mechanism to the bag and then filling the bag from the top and sealing the top of the bag. The clip may be attached by an adhesive, e.g. urethane, or epoxy.

The bag completely sealed around the periphery is an excellent shipping container, because the self sealing valve is not formed until the lower seal is cut off. Other containers having self-sealing valves leak during shipment, for example when a package is dropped sufficient force is generated to open the valve and leak the contents. In contrast, the bag of the present invention remains permanently sealed until the consumer removes the lowermost seal of the bag.

B. The Dispenser

Figure 3:
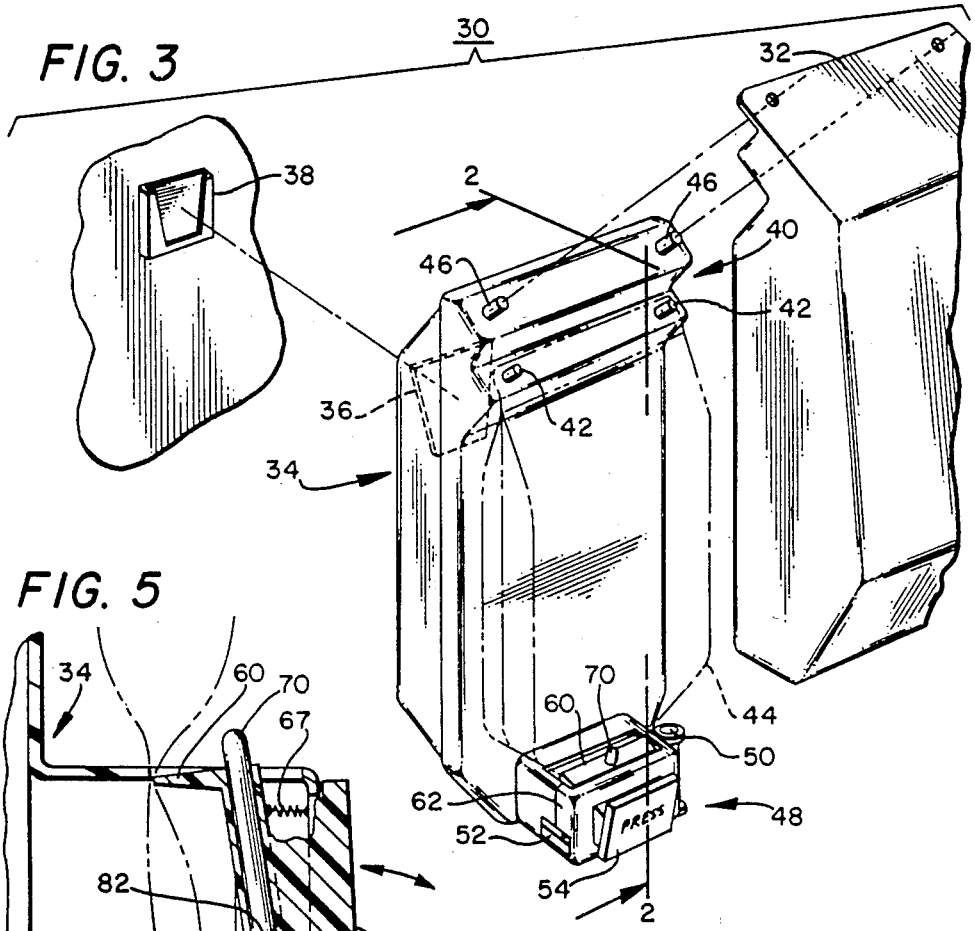
FIG. 3 is an exploded isometric view of the dispenser.

FIG. 3 is an exploded isometric view of the dispenser generally indicated as 30 with its cover 32 removed. Dispenser is composed of a frame 34 which may be constructed of any suitable material such as molded plastic. On the rear of the dispenser frame is a support wedge 36 (shown in phantom) which is to inserted into to wedge receiver 38 which is mounted on a wall. It is clear that other shapes of mounting apparatus and other means of mounting can be used. Of course the dispenser may be supported by any suitable means and it can also be constructed with legs on a pedestal such that it is free standing from vertical walls.

The dispenser has a bag support 40 which is illustrated as a wedge shaped projection from the back of the dispenser frame equipped with two pins 42 which are inserted through corresponding holes provided in the bag 44 (shown in phantom). It will be clear to those in the art that other bag support means can be used. A cover may be placed over the dispenser and bag. The cover is desirable for protection of the bag and for asthetic purposes. The cover 32 is removably attached to the frame 34. In FIG. 3 the cover is supported on pins 46. Any suitable means for attaching the cover may be utilized such as a hinged joint on the side, a hinge on the top, screws, etc. It should be understood that the cover is not necessary for operation, but rather is optional.

At the bottom of the dispenser is the pump indicated generally as 48. The pump can be attached to the frame 34 in a number of ways. The pump can be movably attached to the frame such as, by hinge 50. This allows the pump to be moved to allow placement of the bag in the dispenser. In the preferred embodiment the pump 48 is hinged to the frame 34 and when closed held in place by latch 52. In the embodiment shown, a push bar 54 is provided for actuation of the pumping mechanism by hand.

Figure 4:
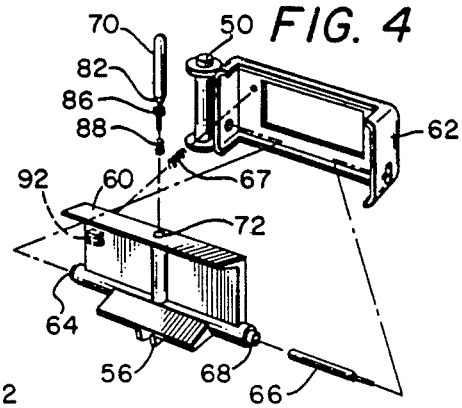
FIG. 4 is an exploded perspective view of the pump.

FIG. 4 is an exploded perspective view of the pump 48. The pump arm 60 is pivotably attached to pump frame 62 by pins 64 and 66. Spring 67 is provided to tension the pump arm in the normal position. The normal position is the closed position where the bottom of pump arm 60 forces the two sides of the bag valve together to provide a positive seal. (See FIG. 7). In the illustrated embodiment pin 64 is a molded section of the pump arm 60 and pin 66 is moveable within horizontal bore 68. A release pin 70 is provided through vertical shaft 72 of pump arm 60. At the bottom of pump arm 60 is a clip receiver 56.

Figure 5:
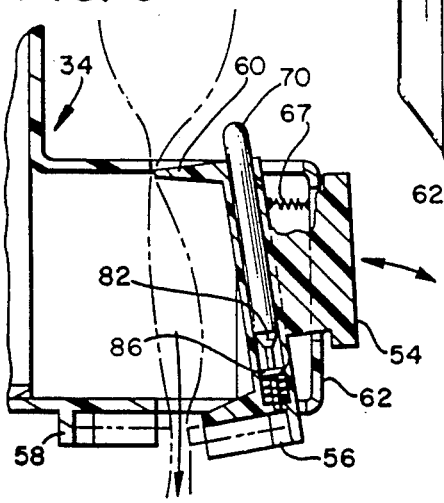
FIG. 5 is a cross sectional view of the pump along line 2—2 of FIG. 3.

In the preferred embodiment the valve actuating mechanism is integral with the pump. FIG. 5, is a cross sectional view of the pump. As the top of the pump arm 60 swings against the lower depending portion of the bag, it pushes the bag against the frame 34, and the bottom of the pump arm 60 moves away from clip receiver 58 attached to the frame, thus causing the moveable clip receiver 56 to move away from clip receiver 58 in the opposite direction, pulling the front and rear bag clips and sides of the bag apart, allowing the liquid to flow. The back side of bag is held by clip receiver 58 attached to the frame. When the pump arm 60 returns to the normal position, the bottom of the arm 60 moves toward clip receiver 58, under pressure of spring 67 thereby pressing the valve portion of the bag together to obtain a positive seal. Those skilled in the art will recognize that the valve actuation mechanism may be separate from the pump arms. Preferably, the valve actuation mechanism and pump arm should act simultaneously.

In the preferred embodiment illustrated, the pump is moveable with respect to the frame by a hinge. When the pump is swung out of the way from the frame, the bag can be placed on the bag support. The rear clip on the bag is inserted in the clip receiver 58 attached to the frame. The pump is then swung shut such that the clip receiver on the bottom of the pump arm engages the clip on the front of the bag. The pump assembly is held closed by the latch 52.

Figure 6:
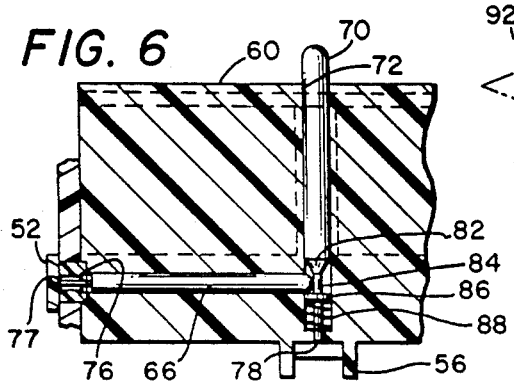
FIG. 6 is a partial cross sectional view of the pump arm along line 6—6 of FIG. 7.

FIG. 6 is a cross sectional view of pump arm 60. In the preferred embodiment the pump arm serves as a housing for a clip ejector and release pin 70. FIG. 6 illustrates release pin 70 in place in shaft 72. Pin 70 is provided with a beveled portion 82 necking to a small diameter 84 section ending in a collar 86 which provides a support for spring 88 and a stop to limit the spring expansion when the shoulder 86 encounters pin 66. When pin 70 is pushed down, the beveled portion 82 of pin 70 bears against pin 66 pushing pin 66 out from the pump arm 60. Pin 66 is provided with a shoulder 76 which limits its outward travel from the pump arm 60. When pin 66 moves outward it disengages latch 52 permitting the pump assembly to be swung outwardly for removal or placement of the bag. The protruding end 77 of pin 66 is beveled so that when the pump assembly is closed the spring action of the latch 52 pushes pin 66 inward against pin 70. A spring may be provided in shaft 68 such that it pushes pin 66 into pin 70. The lower end 78 of release pin 70 when pushed downward protrudes from a hole in the bottom of pump arm 60 and pushes the bag clip out of the clip receiver 56. Once the bag clip is released from the clip receiver 56 the pump assembly may be swung open, the bag removed from the bag support, and the clip on the rear portion of the bag can be disengaged from the clip receiver 58 on the frame. A bag is inserted by supporting the top of the bag on the bag support inserting the rear clip of the bag into the clip receiver 58 (see FIG. 5) and the pump mechanism is then closed and latched and the clip on the front of the bag is pushed into clip receiver 56. The release pin assembly described is not necessary for the operation of the unit. The latch may be manually operated and the clips disengaged manually. However, the release pin assembly is desired.

Figure 7:
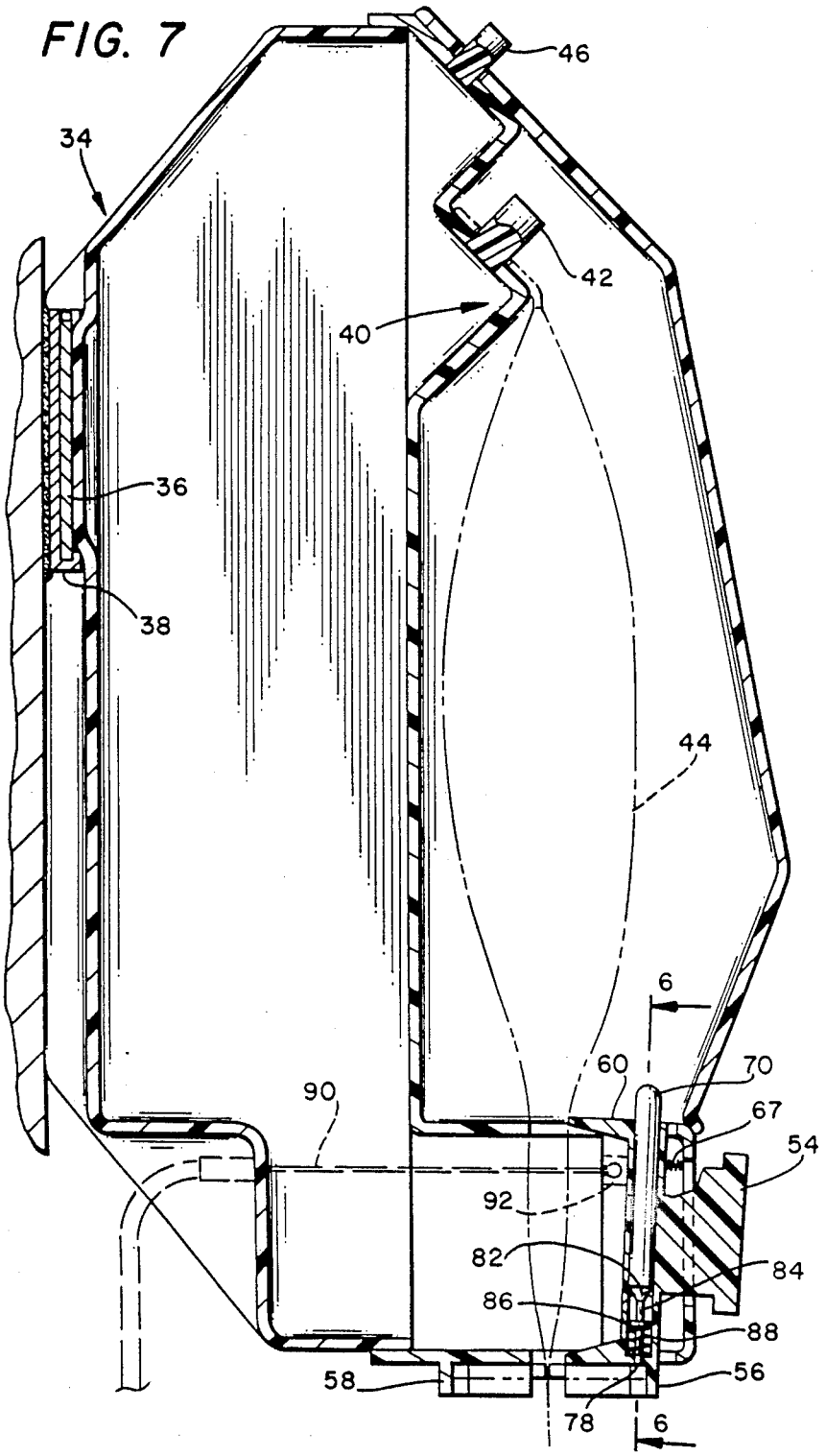
FIG. 7 is a cross sectional view of the dispenser along line 2—2 of FIG. 3.

Liquid is dispensed from the bag by actuating the pump assembly. In FIG. 7 the pump assembly is in the normal position in which the bag valve is closed. In this position the lower portion of the pump arm 60 and clip receiver 56 pushes inward towards the frame and clip receiver 58. This provides a positive seal on the bag because pressure is exerted by clip receiver 56 against the front portion of the bag at the bag clip and forces it against the rear bag clip and rear clip receiver 58. The pump can be activated by hand by pressing inward on the push bar 54 as shown in FIG. 5. This forces the top of pump arm 60 into the bag while simultaneously pulling the front bag clip outwardly, thus opening the bag and allowing discharge of the fluid. Fluid will not flow freely from the bag reservoir because it is cut off by the pressure of the upper portion of the pump arm 60 against the frame 34 (see FIG. 5). When pressure is released, the pump arm returns to the normal position, thereby closing the valve as shown in FIG. 7 and allowing the material in the bag reservoir to flow into the charging chamber, permitting another dispensing of fluid. The charging chamber of the bag is that portion of the bag between the valve and top of the pump arm.

The pump mechanism may be actuated by any suitable means such as hand pressure on a front pressure bar 54 as illustrated or by the attachment of a cable 90 to the pump arm as shown in phantom lines in FIG. 7. The cable can be attached to the pump arm at clamp 92 (see FIG. 4 and 7). The cable can run to the foot pedal on the floor, permitting dispensing of the fluid by foot action. This embodiment of the pump actuation mechanism is a preferred embodiment for surgical scrub procedures to allow the hands to remain free. The pump assembly can also be provided with electric motor or electro magnet which can be activated by photocell, infrared or any other electronic signaling devices.

Figure 9:
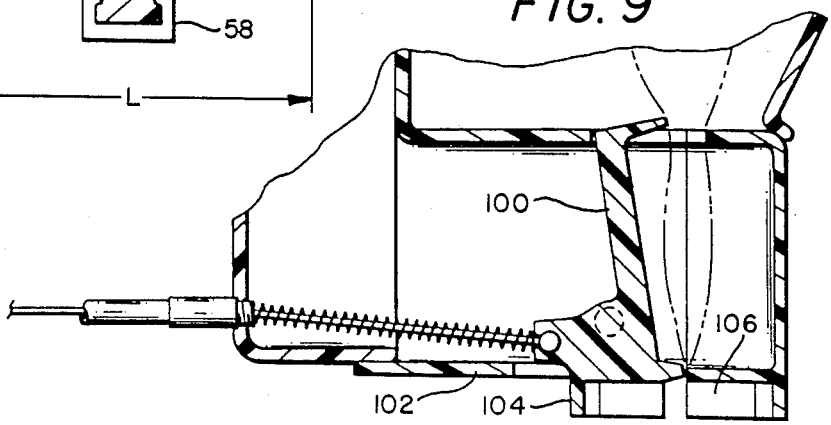
FIG. 9 is a cross sectional view of an alternate embodiment of the pump.

In an alternative embodiment shown in FIG. 9, the pump arm 100 is pivotally attached to the frame 102. The first clip receiver 104 is attached to the bottom of the pump arm 100 and the second clip receiver 106 is movable with respect to the frame. In this embodiment the second clip receiver 106 can be hingedly connected to the frame. The second clip receiver can be swung out to allow a bag to be placed in the dispenser in the same manner as the pump assembly of the preferred embodiment. The second clip receiver is then closed such that it is opposite of the first clip receiver on the pump arm.

The dispenser can have multiple pumps or a single pump arm with several sets of clip receivers to dispense liquid simultaneously, or separately. Thus, a multichamber bag can be used to dispense liquids together, such as epoxy resin and catalyst or separately.

C. Variation in the Dispensing of Fluids

Figure 8:
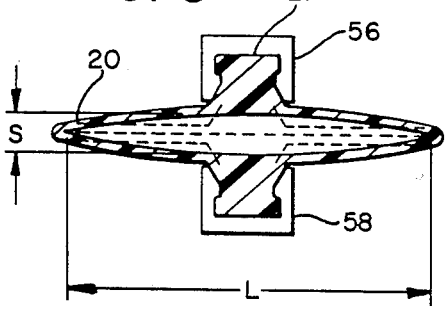
FIG. 8 is a bottom view of the bag valve in the open position.

An advantage of the present invention is that it allows for the dispensing of liquids with a wide variety of viscosities by varying the orifice of the bag and the stroke of the pump arm. The effect of variations in orifice size and stroke is shown in Table I. The stroke is the distance the clip receiver 56 on the pump arm moves through, shown as "s" in FIG. 8. The orifice, when pulled open by the clip receiver, will be a generally elliptical shape. This is illustrated in FIG. 8, a bottom view of FIG. 5. In FIG. 8 the dimensions illustrate the stroke "s" and the width of the valve opening "L". In Table I, L indicates the length of the long axis and D indicates the short axis of the generally elliptical shaped orifice, s indicates the stroke. In all tests the temperature of the fluid was 21° C. and the room temperature was 21° C.

TABLE I

| | Flow Test | | | | |
|---|---|---|---|---|---|
| Test | L inches | D inches | s inches | Viscosity cps | Flow gms** |
| 1 | 0.25 | 0.156 | 0.12 | 500 | 0.33 |
| 2 | 0.5 | 0.281 | 0.187 | 500 | 4.16 |
| 3 | 1.0 | 0.281 | 0.187 | 500 | 4.68 |
| 4 | 0.25 | 0.156 | 0.12 | 30,000 | 1.33 |
| 5 | 0.5 | 0.281 | 0.187 | 30,000 | 5.26 |
| 6 | 1.0 | 0.281 | 0.187 | 30,000 | 5.96 |
| 7 | 0.25 | 0.156 | 0.12 | 100,000 | 0.31 |
| 8 | 0.5 | 0.281 | 0.187 | 100,000 | 3.02 |
| 9 | 1.0 | 0.281 | 0.187 | 100,000 | 4.38 |
| 10 | 0.8? | 0.281 | 0.187 | 300,000 | 3.43 |

**Based on average discharge using (5) strokes to determine an average discharge per stroke. Viscosity was measured by using a Brookfield Viscometer (LVT model).

Figure 10:
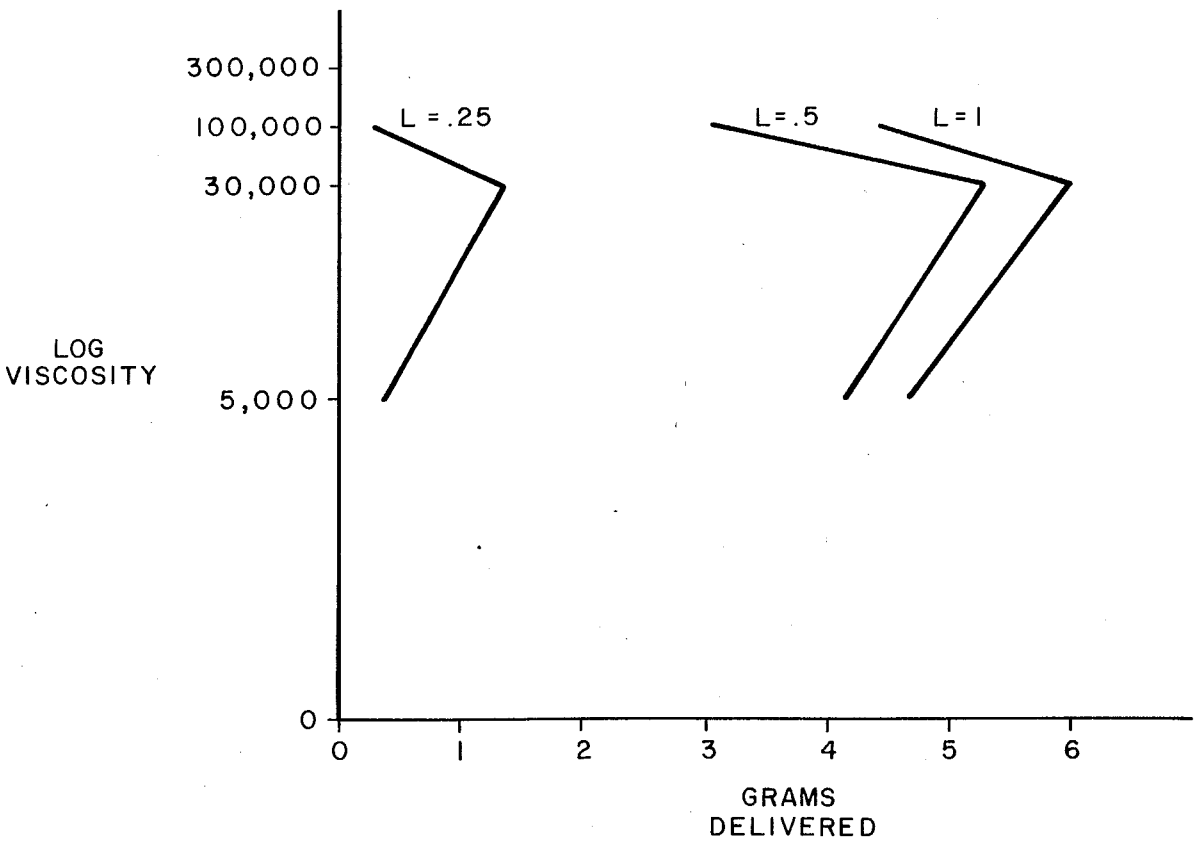
FIG. 10 is a graph of the log of viscosity versus grams of liquid delivered, for various actuator strokes.

Examination of the table shows that the "D" dimension was equal to the "s" dimension in trials 1, 4, and 7, and that the "s" dimension in these trials was less than "s" in 2, 3, 5, 6, 8, 9 and 10. Because of the smaller "D" dimension, it was necessary to accomodate the shorter L. The results of Table I are plotted on FIG. 10 which is a plot of the log of viscosity versus the grams delivered. This plot demonstrates that one can easily adjust amount of discharge by adjustment of these parameters for particular fluid. The compositions utilized in the testing were as follows.

The composition utilized to represent a fluid of 500 cps was a commercially available iodophor surgical scrub (Idex) that was thickened with Natrasol 250 HR (a hydroxyethyl cellulose).

The composition utilized to represent a fluid of 30,000 cps was an experimental formulation of a liquid soap with Carbopol 940 (a polymeric form of acrylic acid) added.

The composition utilized to represent a fluid of 100,000 cps was a commercially available surgical scrub (Ultradex) that was thickened with Natrasol 250 HR.

The composition utilized to represent a fluid of 300,000 cps was a soft hydro-alcoholic gel employing Carbopol 940 as the gelling agent.

The bag may also be constructed in the shape having a plurality of chambers such as shown in FIG. 2. FIG. 2 shows a dual chambered bag. The pump mechanism could also be provided with an equal plurality of clip retaining mechanisms. The pump mechanism could be constructed singularly such that all compartments were pumped and dispensed at the same time, or could be constructed singularly such that each selected compartment was pumped individually, or in a combination. The dual chamber bag would be useful in dispensing such items as epoxy glue, permitting the resin and catalyst to be shipped together.

The bag need only be held sufficiently upright to allow flow of contents to the valve. The dispenser will operate with the bag. It is preferred that the bag be held at vertical ±60° and it is most preferred to hold the bag at vertical ±15°.

What is claimed is:

1. A liquid dispenser for use with a bag comprising:

(a) a frame;

(b) a bag support means attached to said frame for holding a bag containing a liquid in a substantially upright position, said bag having a releasable seal formed by a clip;

(c) a pumping means moveable with respect to said frame to permit the attachment of said bag to said frame, said pumping means further comprising:

(i) a pump arm frame which is moveable with respect to said frame;

(ii) a pump arm pivotally attached to said pump arm frame for movement between a closed and open discharge position;

(iii) a spring means connected to said pump arm and said pump arm frame to hold said pump arm in the closed position;

(iv) a first bag clip receiving means attached to the bottom of said pump arm for receiving a clip on the bag;

(v) a pump arm activating means attached to said pump arm for pivoting said arm; and (d) a second clip receiving means attached to said frame in a location opposite to said first bag clip receiving means when said pump means is attached to said frame for receiving the opposite side of the clip on the bag, movement of the pump arm to the discharge position separates the two sides of the clip on the bag to permit discharge simultaneously opens the valve, and moves the pump arm against the bag to force the discharge of liquid from the bag between the pump arm and bag valve.

2. The dispenser of claim 1 wherein said pump arm activating means is a push bar attached to said pump arm and protruding through said pump arm frame to permit the pivoting of said pump arm by hand.

3. The liquid dispenser of claim 1 wherein said pump arm activating means comprises a cable attached to said pump arm and attached to a foot pedal permitting the pivoting of the pump arm by pressure exerted to the foot pedal.

4. The liquid dispenser of claim 1 further comprising a cover attached to said frame to cover the bag supported by said frame.

5. The liquid dispenser of claim 1 further comprising:

(a) latch attached to said frame;

(b) said pumping means being hingedly attached to said frame such that when closed it is received by said latch, said pump arm further comprising:

(i) a release pin for opening said latch and ejecting the bag clip from the clip receiver on said pump arm passing through a vertical bore in said pump arm, the upper portion of said pin protruding above the top of said pump arm to permit depression of the release pin, said pin having a beveled portion leading to a reduced diameter section, below which is a collar and a second reduced diameter section;

(ii) a spring means contained within the vertical bore of said pump arm disposed between the collar of said release pin and the bottom of the bore such that the reduced diameter portion of said pin does not extend below the pump arm and into the clip receiving means unless the release pin is depressed;

(iii) a pivoting pin passing through a horizontal bore of said pump arm intersecting with said vertical bore of said pump arm, said pivoting pin being outwardly displaceable from the pump arm when said release pin is depressed and the beveled portion of said release pin effects a camming action pushing the pivot pin outward from the pump arm and pump frame to interact with the latching means to effect the unlatching of the hinged pumping means.

6. A liquid dispenser comprising:

(a) a frame;

(b) a bag support means attached to said frame for holding a bag containing a liquid in an upright position, said bag having a releasable seal formed by a clip (c) a pump arm pivotally attached to said frame;

(d) a spring means connected to said pump arm and frame to hold said pump arm in a closed position;

(e) a first bag clip receiving means on the bottom of said pump arm for receiving one side of the clip of the fluid containing bag;

(f) a second bag clip receiving means moveable with respect to said frame to permit the insertion of the bag, said second bag clip receiving means being opposite the first clip receiving means for receiving the opposite side of the clip of the fluid containing bag when attached to said frame;

(g) a pump arm actuating means attached to said pump arm for pivoting said pump arm.

7. A liquid dispensing apparatus comprising:

(a) a collapsible bag comprising:

(i) a first sheet of desired shape;

(ii) a second sheet of the same shape as said first sheet and laminated to said first sheet about the top, and sides to form a bag for containing a liquid having an opening at the bottom to permit the withdrawal of the liquid;

(iii) a clip means having a first and second portion attached to the outside of the bag formed by the lamination of said first and second sheet, and positioned immediately above the open bottom of the bag, said portions being on opposite sides of the bag;

(b) a dispenser for receiving said collapsible bag comprising:

(i) a frame;

(ii) a bag support means attached to said frame for holding said bag containing a liquid in a substantially upright position;

(iii) a pumping means moveable with respect to said frame to permit the attachment of said bag to said frame, said pumping means further comprising:

A. a pump arm frame which is moveable with respect to said frame;

B. a pump arm pivotally attached to said pump arm frame for movement between a closed and open discharge position;

C. a spring means connected to said pump arm and said pump arm frame to hold said pump arm in the closed position;

D. a first bag clip receiving means attached to the bottom of said pump arm for receiving a clip on the bag;

E. a pump arm activating means attached to said pump arm for pivoting said arm; and (iv) a second clip receiving means attached to said frame in a location opposite to said first bag clip receiving means when said pump means is attached to said frame for receiving the other clip on the bag, movement of the pump arm to the discharge position separates the clips on the bag to permit discharge which simultaneously opens the valve and moves the pump arm against the bag to force the discharge of liquid from the bag between the pump arm and bag valve.

8. The apparatus of claim 7 wherein said clip means is permanently attached to said bag.

9. The apparatus of claim 7 wherein said pump arm activating means is a push bar attached to said pump arm and protruding through said pump arm frame to permit the pivoting of said pump arm by hand.

10. The liquid dispenser of claim 7 wherein said pump arm activating means comprises a cable attached to said pump arm and attached to a foot pedal permitting the pivoting of the pump arm by pressure exerted to the foot pedal.

11. The apparatus of claim 7 wherein said dispenser further comprises a cover attached to said frame to cover the bag supported by said frame.

* * * * *

UNITED STATES PATENT AND TRADEMARK OFFICE

CERTIFICATE OF CORRECTION

PATENT NO. : 4,564,127

DATED : Jan. 14, 1986

INVENTOR(S) : Garabedian, et al.

It is certified that error appears in the above-identified patent and that said Letters Patent is hereby corrected as shown below:

Column 4, line 32, delete "to inserted into" and add --inserted into--.

Signed and Sealed this

Sixth Day of May 1986

[SEAL]

*Attest:*

DONALD J. QUIGG

*Attesting Officer*

*Commissioner of Patents and Trademarks*